United States Patent [19]

Marass

[11] 4,129,294

[45] Dec. 12, 1978

[54] SHEET-FEEDING MECHANISM ACTING ON FRONT CORNER REGIONS OF A SHEET

[75] Inventor: Josef Marass, Seehausen, Germany

[73] Assignee: Georg Spiess GmbH, Gersthofen, Germany

[21] Appl. No.: 823,753

[22] Filed: Aug. 11, 1977

[30] Foreign Application Priority Data

Aug. 18, 1976 [DE] Fed. Rep. of Germany ..... 2637218

[51] Int. Cl.[2] ..... B65H 3/40

[52] U.S. Cl. ..... 271/93; 271/107

[58] Field of Search ..... 271/107, 91, 92, 93

[56] References Cited

U.S. PATENT DOCUMENTS

| | | | |
|---|---|---|---|
| 2,060,800 | 11/1936 | Ehrig | 271/93 |
| 2,869,867 | 1/1959 | Backhouse | 271/93 |

*Primary Examiner*—Richard A. Schacher

*Attorney, Agent, or Firm*—Flynn & Frishauf

[57] ABSTRACT

Suction-pulling devices for engaging the underside of a lifted top sheet of a stack of sheet material are carried on short carrier pieces inwardly extending from the respective front ends of two swing rods suspended above the stack near its sides. The swing rods are suspended on two crank arms, the most rearward of which is continuously driven to cause the front ends of these rods to describe an oval path in the vertical plane. The upper part of this path, which provides the forward motion, matches the speed of a suction lifter for the top sheet in a rear path portion and matches the linear speed of the drive rolls of a succeeding transport device in a forward portion. The suction-pullers are rotatable about a horizontal axis to fit the lay of the sheet being transferred and a control cam on a bearing of the rear supporting crank arm also produces a slight outward pull of the suction lifters during the forward motion to stretch the front edge of the sheet.

18 Claims, 3 Drawing Figures

1
2
3
4
5
6
7
8
9
10
11
12
13
14
15
16
17
18
19
20
21
22
23
24
25
25a
26
27
28
29
30
17a
50
51
52
53
54

SHEET-FEEDING MECHANISM ACTING ON FRONT CORNER REGIONS OF A SHEET

This invention relates to a sheet-feeding mechanism provided with apparatus for repetitively separating the top sheet of a stack of sheets of material having at least the stiffness of paper and transferring the sheet so separated to an apparatus for transporting the sheet, usually horizontally, away from the stack a short distance to where it can be picked up by another transport mechanism, for example the intake rolls of a printing press. In particular the invention relates to sheet-feeding mechanisms utilizing suction sheet-pulling devices for the initial transfer of a top sheet separated from the stack by the separating apparatus, the suction sheet-pulling device having an operating path in the form of a closed curve in which it moves in the feed direction and back, traveling under the leading edge of the separated sheet as it moves back to grasp it on its underside and then to pull it forward towards the succeeding transport apparatus, for example the previously mentioned intake rolls.

It is advantageous to grasp the sheet in each case at its front edge, so that a more accurate introduction into the succeeding sheet transport apparatus can be provided. In recently conventional sheet-feeding devices, the sheets to be fed were, in contrast to the above-described practice, lifted up in the region of the rear stack edge and the front edge of the sheet was put into a suspended condition merely by blowing air in from behind. Such an arrangement was inherently unfavorable for providing precise delivery of the forwardly transported sheet to a succeeding transport apparatus. In the course of time these conventional sheet-feeding devices nevertheless achieved a construction of such matured design that in spite of this subsisting basic disadvantage, results that were nevertheless satisfactory could heretofore be obtained. With increasing rapidity of operation, however, limitations were bound to be imposed by such construction.

German Pat. No. 648,580, on the other hand, made known an arrangement of the kind in which the sheet is grasped near its forward edge which, however, evidently did not prove out in practice. In this arrangement two or preferably more separating and pulling suction devices in the form of components independent of each other were provided which simply were arranged and provided, together with their entire drives, in the region between the front stack edge and the succeeding sheet transport apparatus to be fed by these various devices. There resulted, evidently, tightly limited space relations because of the required large spacings for their introduction and, hence, an increase of the overall construction volume, since for the avoidance of mutual interference there had to be play space available in sufficient quantities for these groups of suction devices dancing around each other. An increase of the spacing between the front stack edge and the succeeding sheet transport apparatus, necessarily involved an increase of the transport path necessary to transfer sheets from the stack to the transport apparatus to be fed. In the case of a large spacing in terms of height, and particularly in the processing of relatively thin paper sheets, it was found that a sheet lifted on its forward edge droops sharply and remains with its rear region lying for a relatively great length on the upper edge of the stack. It is then hardly possible to get under such a sheet for lifting the next one. Furthermore, in this type of case there is a risk that the rear sheet end will crinkle up. In addition, the presence of relatively long transport paths also has a negative effect on the dimensioning of the drive components, because the latter then become heavy and have excessive inertia. So far as regards the construction of the drive for the above-mentioned groups of suction elements no teaching is to be derived from the above-mentioned German Pat. No. 648,580 except for a movement curve of the suction lift device indicated as a four-cornered figure. A movement curve of this type could hardly be realized with economically justifiable expense.

German Pat. No. 693,804 supplies some information in elaboration of the above-mentioned arrangement constituting portions of a drive apparatus for the two groups of suction devices that were evidently regarded at the time as advantageous. According to the teaching to be derived from that disclosure, suction rods were to be provided extending across the entire stack width and provided along their length with a number of suction devices, which are laterally or centrally held on a swinging lever. The swing lever for holding the suction sheet-pulling devices was in this arrangement coupled with the swing lever of the separator suction rod. There is no explanation in this disclosure regarding the drive source itself and the manner of initiation of the drive. So far as concerns the general disadvantages resulting from the drive elements disposed in front of the front stack edge for both of the suction device groups, the above-mentioned considerations are applicable also here. As can be particularly readily noticed from the arrangement of the swinging lever of the suction pullers as a part bent around the succeeding transport apparatus and its drive components, the limited space conditions can be full of problems. Particularly when swinging levers are used, the spacing considerations can lead to very long and hence extremely vibration-vulnerable components that must be correspondingly of heavy cross section. Furthermore, the coupling of the lift suction devices with the drive of the pulling suction devices produces a great degree of complication of the overall drive mechanism. Apart from that, for obtaining a certain necessary play space between the swing levers coupled together in their drive, it is necessary in the known apparatus to have suction rods stretching over the entire stack width which, in consequence of their length and their not inconsiderable weight, are considerably endangered by vibration and oscillation. Constructions of this type could come into consideration in any event mainly for small sheet formats. In addition, the use of straight suction rods in the case of a wavy stack top surface provides no sure sheet pick-up. Finally, the components stretching over the entire machine width can hardly or only with the greatest difficulty be maintained and serviced. The disadvantages of this known construction accordingly consists particularly in their increased space requirement in the region between the front stack edge and the succeeding sheet transport apparatus as well as their heavy and vibration-vulnerable construction which is generally suitable only for the processing of very small formats at extremely slow speeds.

For relief from these defects an apparatus was even suggested that provides two or preferably more groups of suction systems side by side over the working width of the sheet-feeding device, with each group consisting of two or three individual suction heads succeeding each other in insertion, provided with blowing and suction nozzles respectively at two places on their surfaces. Each suction head is therefore capable of holding two sheets. If in this arrangement a suction head of one group has lifted the top sheet of the stack, the next suction head will then go beneath it, so that the lifted sheet will be transferred from the underside of the upper suction head to the upper side of the lower suction head. Since in this known device, however, in each case two or three suction heads are placed next to each other that are put into operation successively, the spacing between the simultaneously operating suction devices is very large. In the processing of large formats it can therefore easily occur in this case that the sheet corners are no longer grasped and extend unduly far or as the result of their weight, hang over. The result of that effect can be that the sheet will crinkle at this place. Furthermore, insertion of a suction head under such a sheet is nearly impossible without damage to the sheet. In any event, devices of this kind have also made no significant entry into practice so far.

Furthermore, a device has recently become known that goes back again to the use of suction rods. In this case, however, the suction rods are rotatively mounted on both sides in a bearing that is itself rotatable and the rods are equipped on two sides respectively with suction and blowing nozzles and revolve with each working stroke. The space for movement for these proposed doublesidedly operating suction rods is limited by the stack surface and the sheet delivered to the succeeding sheet transport device. Accordingly, in this arrangement too, in the region between the stack and the succeeding sheet transporting device it is necessary to take care to assure that there is sufficient room for mechanical movement, so that larger height spacings cannot be avoided. This therefore leads, particularly in the processing of thin paper, to a marked sagging of the far uplifted sheet and accordingly gives rise to a risk of buckling of the sheet and consequently the occurrance of crinkle folds. Furthermore, the insertion of apparatus heads under a sharply drooping sheet must be extremely difficult. These disadvantages come out particularly clearly because in this case the sheet sticking to the underside of the suction rod lying above it is first lifted for delivery of the top sheet to the succeeding sheet transport device and immediately thereafter it is lowered again for transfer to the upper side of the suction rod lying below it. In the case of sharply drooping material occurrence of buckling must therefore be hardly avoidable. Furthermore, the movement of the two suction rods is designed to be practically stepwise. For this purpose a very expensive stepwise drive is as a rule necessary. Finally, the disadvantages of suction rods extending over the entire machine width with regard to service and operation reliability in the case of a wavy stack suface are not overcome. Systems of this type have likewise not made headway in industry.

It is an object of the present invention both to overcome the disadvantages of the known devices and systems and to provide a simple and highly economical equipment in which suction heads pull separated sheets off the top of the stack by the forward edge and particularly an apparatus that has space economy and permits a compact construction so as to be free of limitations regarding format size and paper strength and also makes possible increased operating speeds with a high safety and reliability of operation.

SUMMARY OF THE INVENTION

Briefly, suction sheet pullers are provided that are operated in the region of each of the two forward sheet corners respectively mounted toward each side on swing rods above the stack, extending forwardly to the region of the front stack edge and pivotally suspended in each case on two crank arms. An inwardly directed carrier piece equipped with a suction pulling head is freely rotatively mounted at the front end of each swing rod. The carrier piece is arranged to be swung under control of a cam provided on one of the crank arms on which its swung rod is suspended. A precisely carried out decoupling, with respect to reciprocating drive, of the operation of top sheet separation and sheet feeding in the apparatus of the present invention makes it possible in particular to obtain exactly the particularly desired velocity in the critical regions of the movement curve of the sheet transporting suction-puller, which is essentially accomplished by the appropriate choice of crank arm and swing rod length in accordance with known geometric principles. In practice the velocity of the suction-puller in the approach to the forward end of its path of movement is so designed that it approximately matches the transport velocity of the succeeding sheet transport device. A reliable and jerk-free sheet delivery is thus accomplished. The top sheet separation advantageously remains unaffected by features of this type. Consequently, the suction-puller assembly of the present invention can also operate with any top sheet separation apparatus and it is not limited to use with suction-type separaters such as are shown for illustrative purposes in the specific embodiment described below.

The arrangement of the swing rods that carry the suction-pullers in a disposition to each side above the stack incidentally provides good accessibility to the equipment and assures simple maintainability and servicing. At the same time it makes possible the grasping of each sheet to be pulled without particular complication in the region of its front corners, whereby drooping or overhanging of the edge portions of the sheet and the consequent risk of buckling and crimping are effectively avoided. Furthermore, the space saving makes possible, particularly in the middle portion of the front edge of the sheet, the provision of stack height sensing devices for cooperation with the functioning of the stack hoist drive, thereby effecting a systematic control of the stacking table level concurrent with and corresponding to the removal of sheets from the top of the stack.

As a result of the compact construction made possible by the present invention, very short feed paths are provided to transfer sheets from the top of the stack to a succeeding sheet transport device, the short path having a positive effect on the reliability of transfer and undamaged sheet delivery. In this regard it is also advantageous that the tilt attitude of the suction-puller can be changed in the course of its movement in a curved path and thus can always be set up in the most favorable arrangement. A reliable grasping with normal suction devices is possible in this apparatus even with unusual material and unusual formats. The principal advantages available through the present invention are accordingly the remarkable simplicity, the reliability and hence, on the whole, its economy.

According to an advantageous development of the invention, the control cams can take the form of fixed disks mounted on the crank pins of the rear crank arms. In this case, each carrier piece can be provided with a control lever arm that is connected through a control rod with a pivoted lever having a bearing on the swing rod and carrying a cam follower cooperating with the control cam. In this manner, the control of the swinging movement of the suction-pullers is thus provided with an individual drive. The placing of the control cams back on the rear crank arms furthermore assures that a sufficiently large disk diameter can be provided without sacrifice of maintainability and observability of the suction heads. In order to provide adjustability, the disk can be made detachable or capable of being loosened from its fixed position.

For maintaining reliable contact of the cam follower against the control cam, a compression spring can conveniently be provided around a part of the control rod and held at one end at the front crank bearing and at the other end by a stop mounted on the control rod. The control rod can advantageously be provided with support where it passes by or through the bearing structure of the front crank arm in order to prevent undue bending load on the control rod.

It has been found desirable to provide a certain outwardly directed stretching of the front edge of the sheet, which can readily be provided in the apparatus of the present invention by utilizing the swinging movement imparted to the suction-pullers to obtain an outward component moving them apart. In accordance with another step of the present invention, the carrier pieces can for this purpose be made axially shiftable in their bearings at the front end of the corresponding swing rod and a swinging movement produced by the control cam can be caused by a converting device to produce an axial movement of the carrier piece. An oblique guiding surface in the neighborhood of the carrier piece bearing can provide the necessary conversion and this is done with particular simplicity and economy when an oblique slot is provided in the bearing bushing in which the carrier piece is supported, while a pin connected to the carrier piece engages in the slot. In order that the moments operating on the control rod may be reduced, the control rods can desirably be connected by pivot bearings to the corresponding levers.

A further improvement of the invention can be effected by constituting the swing rods as air conduit tubes. The separation of functions by which the top sheet separator machinery and the sheet feeding machinery are separately organized greatly favors the provision of the swing rods of the sheet feeding mechanism as air conduit tubes. The suction or blowing air can thus be simply and cleanly guided inside the drive and carrier components.

At least one of the suction-pullers should be laterally adjustable in order to provide adjustability to suit different format sizes. For small variations, it is sufficient if the corresponding carrier piece is extendable by being pulled out somewhat. For greater variations, it is practical to provide lateral adjustability for each of the complete assemblies at each side of the stack. In such an arrangement, the crank arms can advantageously be provided at their hubs with axle or shaft stubs that are rotatably supported in axially shiftable bearing plates. Then, for the provision of a common drive shaft for both swing rod assemblies, the drive shaft can conveniently be constituted as a hollow shaft, into which the driven shaft stubs belonging to the rear crank arms are introduced. Such features make it possible to provide a quick and precise resetting of the machine to different format sizes and thus contribute further to economy of operation.

A further development of the invention can provide for relative rotation of the rear crank arms, by means of their shaft stubs, during operation of the machinery. The effect of such a relative rotary shift superimposed on the normal drive is a corresponding acceleration or retardation of one suction-puller position with respect to the other. In this manner, there will evidently be produced a swinging around of the sheet pulled by the suction-pullers, so that a straightening of the sheet can advantageously be produced in this fashion. It is practical in this connection to mount the suction-pullers so that they are freely rotatable on the corresponding carrier pieces, in order to avoid distortion of the sheets.

A particularly simple and advantageous arrangement for producing such a relative rotary shift is obtainable by providing oppositely running oblique guides in the respective portions of the two shaft stubs engaged in the hollow drive shaft, while providing also for an axial control shift of the drive shaft. These oblique guides can conveniently be provided as slot and pin connections. Then by a corresponding axial shift of the drive shaft, oppositely directed rotation of the two driven shaft stubs can be produced.

The invention is described in further detail by way of illustrative example with reference to the annexed drawings, in which.

Figures 1, 3:
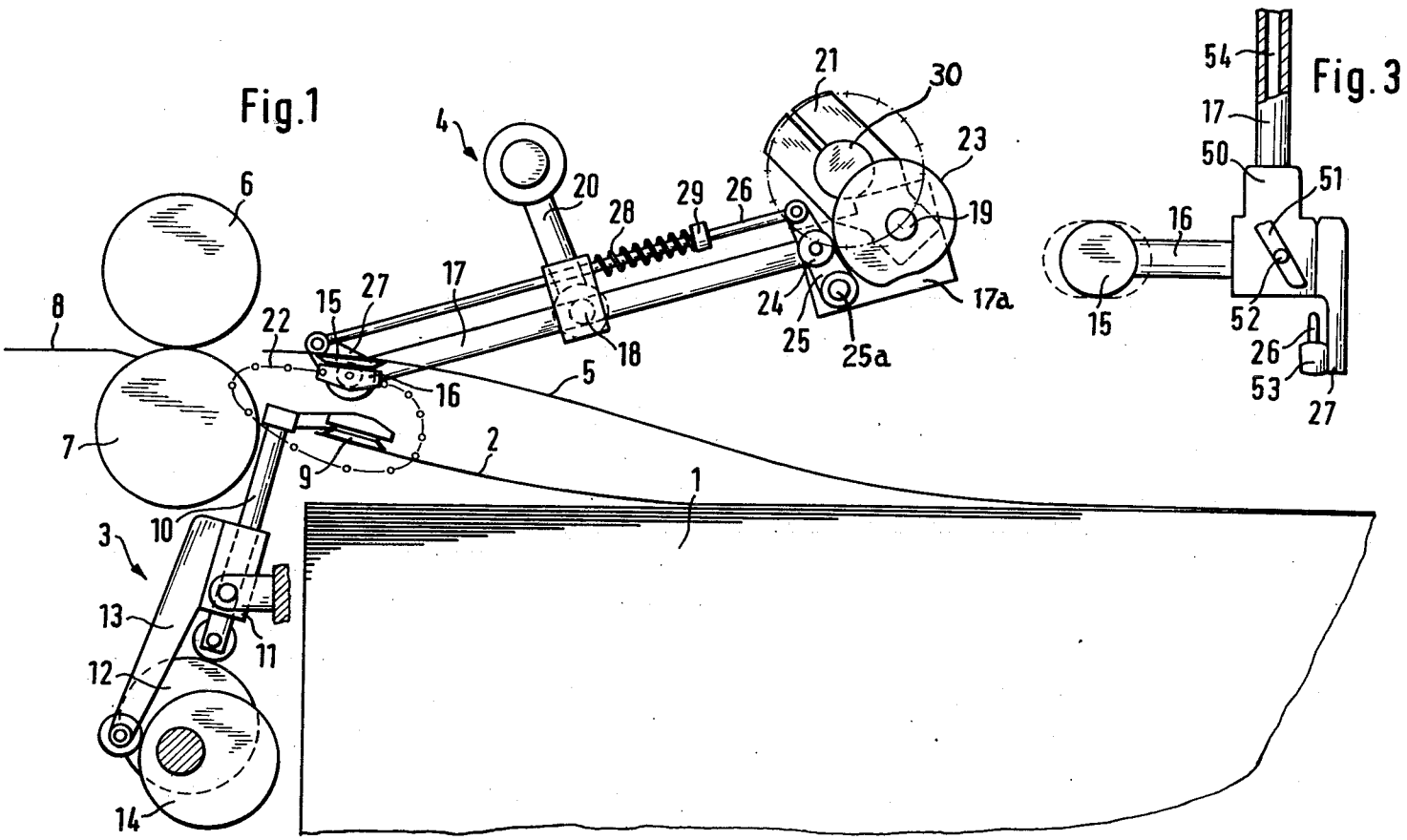
FIG. 1 is a diagrammatic side view of a sheet-feeding mechanism in accordance with the invention, together with a suction-type top sheet separator.
FIG. 3 is a bottom view of a preferred embodiment of the arrangement for lateral stretching of the transported sheet.

Sheet-feeding mechanisms as a rule have a portal-like machine frame on which a stack hoist hangs and on which the movable parts for the feeding of the top sheets in succession are mounted. In the diagrammatic representation given in the present drawings, the details of the machine frame and of the stack handling machinery have been left out to clarify the illustration of the sheet-feeding mechanism. In FIG. 1, the reference numeral 1 represents the sheet stack of which the top sheet 2 is lifted up in the region of the front stack edge by a top sheet separating device designated generally as 3. Above the stack 1 is the sheet-feeding device of the invention designated generally as 4 to which the top sheet is delivered for pick-up and transfer, as shown at 5, by the device 4 to a succeeding sheet transport apparatus, here shown as a set of rolls, 6 and 7, which in a known way lead the sheet to a ribbon table 8 etc., not further shown in the drawing.

Air blowing jets can be used in a known way for separating the top sheet. In the illustrated example, however, the top sheet separator device 3 is provided with suction lift heads 9 each mounted on a tube 10 that is axially movable in a supporting bushing 11 and is caused to move up and down by an eccentric drive 12. Preferably the suction lifters 9 are at the same time given a certain swinging movement. For this purpose, the bushing 11 is pivotally mounted and is swung by means of an arm 13 integral with the bushing that rides on a second eccentric member 14 that is driven uniformly together with the eccentric member 12. An arrangement of this sort is advantageously simple and space-saving and nevertheless reliable.

According to the invention, suction-pullers 15 are respectively coordinated with each of the suction lifters 9, although independently provided with their particular motions, there being no link between the more or less reciprocating motions of the assemblies 3 and 4 of FIG. 1, the coordination being merely assured by the locations of the assemblies 3 and 4 near each side of the stack and the powering of all their respective basic drive shafts from a common source (not shown). Each suction-puller 15 is carried by a carrier piece 16 that is pivotally mounted so that it can swing at the front end of a swing rod 17 that extends forward from its suspension to reach the region of the front edge of the stack 1. The swing rod 17 is suspended on a front crank arm 20 and a rear crank arm 21 respectively journaled on crank bearings 18 and 19. The rear crank arm 21 is driven continuously, normally at constant speed. This causes the front end of the swing rod 17 to describe the motion curve indicated by the dot-dash line 22. In order to swing the suction-puller 15 in the desired position at each region of the motion curve 22 of the swing rod end, a control cam 23 is mounted on the bearing pin of the rear crank bearing 19, being formed preferably as a disk and fixed more or less adjustably on the bearing pin. The control disk 23 operates through a cam follower 24 mounted on a pivoted lever 25 swinging on a pivot stud **25*a* set in the somewhat widened rear end 17*a* of the swing rod 17. The control lever 25 operates a second control lever 27 through a control rod 26. The second control lever 27 is mounted on the side of the front end of the swing rod 17 and operates as the control lever for the carrier piece 16 of the suction head 15. The nature of the motion produced by the cam 23 is further discussed below. In order to assure a continuous contact of the cam follower 24 with the control cam 23, a compression spring 28 is provided that is compressed between the stop collar 29 affixed on the rod 26 and part of the structure of the bearing 18 for the end of the front crank arm 20. In order to relieve the control rod 26 of any tendency to bend under stress, a loose guide or support surface can be provided for it in the region of the bearing 18 of the end of the forward crank arm 20**.

Figure 2:
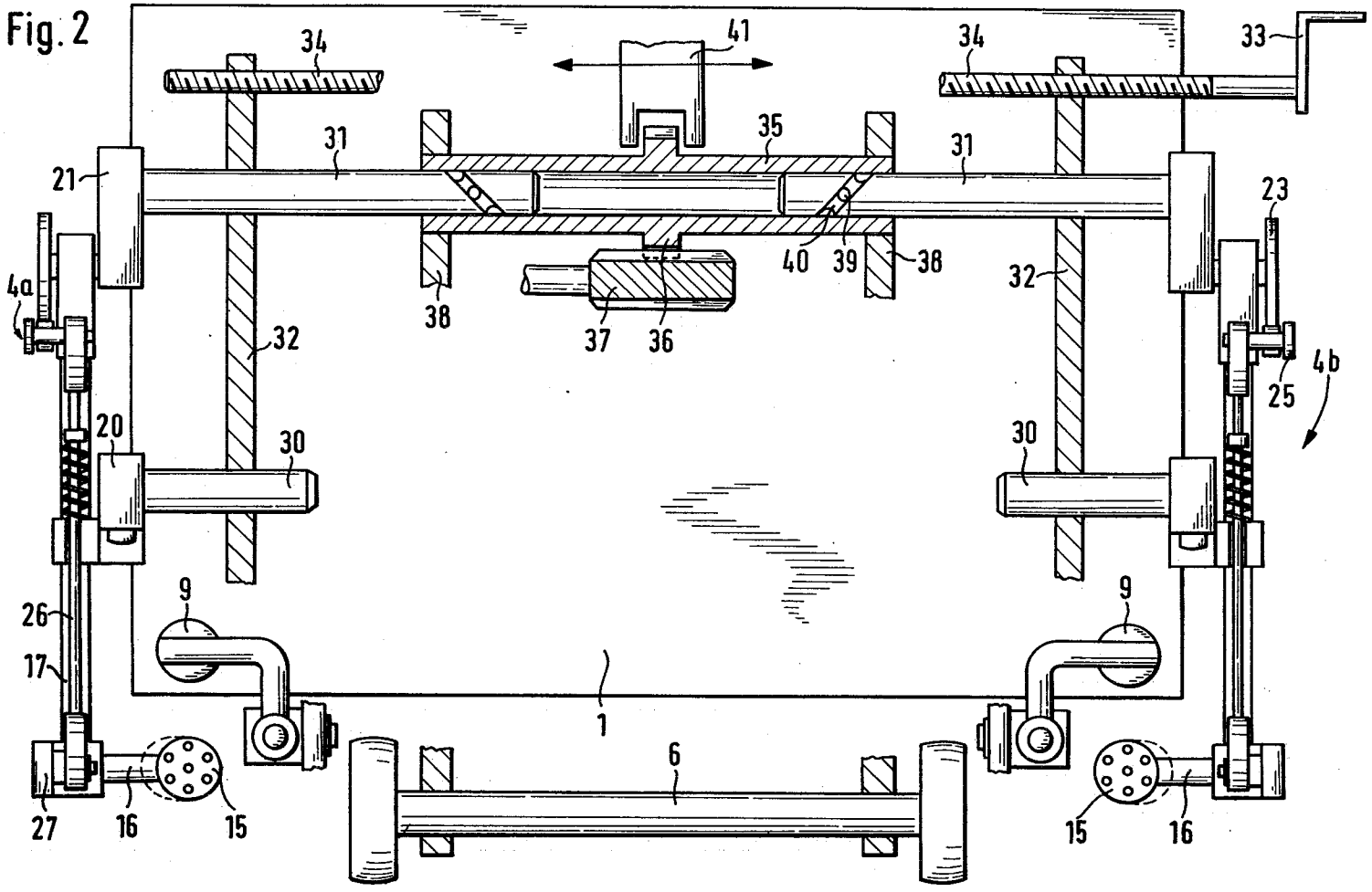
FIG. 2 is a plan view of the sheet-feeding mechanism of FIG. 1, partly in section.

As can best be seen in FIG. 2, a complete sheet transport assembly 4 is provided above the stack 1 in the region of each stack side, the one at the left being designated **4*a* and the one at the right 4*b*. The length of the carrier pieces 16 rotatably mounted on a horizontal axis at the respective front ends of the swing rods 17 and provided with the respective control levers 27 is so chosen that the suction-pullers 15 in each case come into operation in the region of the respective front corners of the top sheet of the stack 1. Preferably the suction lifters 9 are similarly located as shown in FIG. 2. In this way, a reliable opposite application of the suction heads, each operating as a stop for the other upon the transfer of a sheet from one to the other, is made sure. The grasping of a sheet at the front stack edge furthermore assures that the lateral edge still possibly projecting to the side can be kept as small as possible, so that buckling of the corners is practically out of the question. The top sheet separating assemblies 3 are offset so far to the side of the stack, that the pairs of rolls 6 and 7, of which only the top pair 6 is visible in FIG. 2, are in no way hindered nor limited in any practical sense. There is plenty of space available for placing these pairs of rolls close to the stack, because the sheet transport assemblies 4 according to the invention are arranged above the stack 1** near its sides. A further advantage of this lateral arrangement is to be found in easy accessibility to the machinery and to the stack.

In order that with any change in the format size it will always be possible to locate the suction devices handling a sheet of the stack so that they act on the front corners of the sheet, the assemblies of the top sheet separating apparatus 3 and of the sheet transport apparatus 4 are laterally adjustable in position. For this purpose, it is practical to provide the crank arms 20 and 21 at their hubs with axle stubs 30 and shaft stubs 31 respectively, which are supported in bearings mounted in bearing plates 32 that in turn are laterally shiftably mounted in the machine frame. Shifting of the bearing plates 32 can be controlled, for instance, by means of a threaded spindle 34 actuated by a hand crank or wheel 33. The threading of the spindle 34 is oppositely wound on the two sides of the machine and of course cooperates with mating threaded bushings (not shown) held in the bearing plates 32, so that the turning of the spindle 34 can spread the parallel plates 32 apart or draw them together. It is also possible to provide a positioning motor (not shown) instead of the hand crank 33 for setting the spacing of the bearing plates 32. A somewhat similar positioning apparatus can be provided for the setting of the spacing between the two assemblies of the top sheet separator equipment 3. For making adjustments of small scope, or for providing a fine adjustment of the lateral position of the suction-pullers 15 with respect to the suction lifters 9, it can be convenient in some cases to make the carrier pieces 16 extendable by drawing them out (inwards of the machine), thus adjusting the average distance of the suction head 15 from its swing rod 17.

As already indicated further above, the drive torque for sheet transport is to be introduced at the hubs of the rear crank arms 21. In arrangement with assemblies **4*a* and 4*b* that are not laterally shiftable, the rear crank arms 21 can be mounted simply on a common drive shaft. In the illustrated embodiment, in order to allow for the lateral adjustability already described, a hollow drive shaft 35 is provided into which the shaft stubs 31 of the respective rear crank arms 21 adjustably penetrate in driving engagement. The drive shaft 35 can, for example, be provided with an external pinion 36 which cooperates with a spur gear 37 driven by the common drive (not shown) of the equipment illustrated in FIGS. 1, 2 and 3. The fixed bearings of the drive shaft 35 are indicated at 38. In a different embodiment, individual drive motors for the shaft stubs 31 could be fastened to the bearing plates 32**.

During operation, as already mentioned, the rear crank arms 21 are driven continuously at normally constant speed. The front ends of the swing rods 17 and thus also the corresponding suction-pullers 15 then follow the motion curve shown at 22 in FIG. 1. On account of the swinging crank arrangement according to the invention, such curve shapes can be obtained without resorting to control cam disks and the like, providing a considerable advantage in case it should be desired to increase the machine speed. In the rear region of their motion curve 22, the suction-pullers 15 move under the sheet 2 lifted by the corresponding suction lifters 9 and grasp the sheet on its underside with their upwardly directed face plates. The velocity of the suction-pullers 15 and the suction lifters 9 are preferably so determined that at the moment of sheet transfer, these velocities are the same. The sheet grasped by the suction-pullers 15 is then transported farther along the curve 22 up to the roll pairs 6 and 7. Because of the features of the present invention, the diameter of these rolls can be made sufficiently large to assure a reliable pick-up of the sheet. In order to obtain in each part of the curve 22 an inclination of the suction-pullers 15 fitted as closely as possible to the natural position of the sheet in motion, the suction-pullers 15 are, according to the invention, correspondingly pivotable. This feature guards against a peeling off of a sheet grasped under its underside, and any consequent disadvantageous operational disturbances. In the forward turnabout region of the curve 22, the transfer of the sheet to the rolls that are to transport it further takes place. In this region, therefore, equal operating forward speeds of suction-pullers and roll surfaces are provided. As soon as the passing sheet has been let go, the suction-pullers move down and back to go below the next sheet that is by then already lifted, and then the cycle of operation is repeated in the same way. The suction-pullers 15 and the coordinated suction lifters 9 are laterally set one above the other, so that upon transfer, a mutual stop effect is provided. The suction lifters 9 and the suction-pullers 15 operate in a known way with air suction. Known control means for turning the vacuum on and off can be applied to the machinery here described and does not need to be further explained here.

It occurs now and then that the sheets of the stack 1 are not exactly aligned in the direction of feed. In cases of this sort, it is therefore particularly useful to provide means to enable a certain straightening or realigning of these sheets. In the machine of the present invention, this can be simply accomplished by making the driven shaft stubs 31 that operate the respective rear crank arms 21 slightly rotatable with respect to each other. For this purpose, in the engagement region of the shaft stubs 31 in the hollow shaft 35, oppositely directed oblique guides are provided that, as indicated at 39 and 40, are preferably constituted as pin and slot connections. To produce on both sides a lateral shift of the assemblies **4*a* and 4*b* apart from each other or together, the slot 40 can take the shape of a spiral slot and a fork shaped positioning member 41 can be provided bracketing the pinion 36 for shifting the hollow shaft 35 axially one way or the other. The width of the spur gear 37 is so chosen that for every position of the hollow shaft 35, within the scope of axial shift that is provided, there will always be an appropriate driving engagement between the spur gear 37 and the pinion 36**.

Finally, it can be useful to stretch the sheet laterally before its delivery to the rolls 6 and 7. For this purpose, it is necessary to spread the suction-pullers 15 that grasp the sheet slightly apart from each other. To produce such an outward stretching movement of the suction-pullers 15 in the machinery of the invention, the swinging motion produced by the control cams 23 can advantageously be utilized. As is most readily observed in FIG. 3, the carrier piece 16 that is equipped with a laterally disposed control lever 27 holds the suction-puller 15 by a somewhat T-shaped front bearing portion 50 of the swing rod 17. In order to provide a device for converting the swinging motion into an axial motion, the bearing portion 50 can be provided with an oblique slot 51 in which a pin 52 connected to the carrier piece 16 engages. As a rule, an axial (horizontal) movement of the order of magnitude of about 3 to 6 mm is sufficient. This is particularly easy to provide with a pin and slot connection of the illustrated type. In FIG. 3, the end positions of the suction-puller 15 are shown by broken lines. FIG. 3 also illustrates how the control rod 26 can advantageously be connected to the control levers 25 and 27 by pivoted bearings such as the bearing 53 shown for the case of the control lever 27. Stresses are thereby obviously avoided. By a suitable shaping of the control cam 23, it is likewise easy to prevent the stretching movement from shortening the swinging angle about the axis of the carrier piece 16 which is desirable for the suction-puller 15 as already mentioned.

In a preferred embodiment illustrated in FIG. 3, the swing rods 17 as well as the carrier pieces 16 can be constituted as tubes to serve as air ducts, as shown for example for the case of the swing rod 17 at 54. In this manner, the use of flexible tube connections and the like can be reduced or avoided.

Although the invention has been described in detail with reference to a particular preferred embodiment, it will be understood that variations and modifications are possible within the inventive concept.

I claim:

1. A sheet-feeding mechanism provided with apparatus for repetitively separating a top sheet of a stack of sheets of material having at least the stiffness of paper and transferring said sheet to apparatus for transporting the said sheet to other apparatus capable of accepting said sheet, comprising in combination:

top sheet separator means (3) located adjacent to front edge of a stack (1) of sheets that is in position for sheet-feeding and having suction lift heads (9) located above the respective front corner regions of the top sheet of said stack, for lifting at least the front edge of said top sheet (2) off the top of the stack;

first and second swing rod means (17) mounted so as to be able to swing near the respective sides of said stack for producing motion of their respective front ends in the respective regions of each of the front corners of said top sheet, in each case suspended on two crank arms (20,21) both located above said stack;

an inwardly directed carrier arm (16) mounted rotatably with respect to its length axis on each of said swinging rod means (17) at the front end thereof;

a suction sheet-pulling device (15) on each of said carrier arms (16); and control means including a cam (23) mounted on one of said crank arms (20,21) for rotating each of said carrier arms (16) about its length axis;

whereby said suction sheet-pulling devices (15) are caused to be moved in a closed curve in the feed direction and back, moving below the lifted top sheet to grasp it on its underside beneath the respective most lifted portions thereof to lead it to a succeeding transport mechanism.

2. A sheet-feeding mechanism as defined in claim 1, in which as said suction devices approach the forward end of said closed curve, their velocities are about the same as that of the adjacent moving surface of said succeeding transport apparatus (6, 7).

3. A sheet-feeding mechanism as defined in claim 1, in which said cams (23) are respectively mounted in fixed position on the crank pins (19) of the more rearward (21) of said two crank arms.

4. A sheet-feeding mechanism as defined in claim 1, in which said swing rod means (17) and their respective carrier arms (16) are constituted in the form of air suction ducts.

5. A sheet-feeding mechanism as defined in claim 1 in which at least one of said suction sheet-pulling devices (15) is laterally shiftable in position.

6. A sheet-feeding mechanism as defined in claim 5 in which the carrier arm (16) of each said laterally shiftable suction sheet-pulling device is constituted as an arm that is extendable by pulling it out.

7. A sheet-feeding mechanism provided with apparatus for repetitively separating a top sheet of a stack of sheets of material having at least the stiffness of paper and transferring said sheet to apparatus for transporting the said sheet to other apparatus capable of accepting said sheet, comprising in combination:

top sheet separator means (3) located adjacent to front edge of a stack (1) of sheets that is in position for sheet-feeding, for lifting at least the front edge of the top sheet (2) of said stack off the top of the stack;

first and second swing rod means (17) for producing motion of their respective front ends in the respective regions of each of the front corners of said top sheet, in each case suspended on two crank arms (20,21);

an inwardly directed carrier arm (16) mounted rotatably with respect to its length axis on each of said swinging rod means (17) at the front end thereof;

a suction sheet-pulling device (15) on each of said carrier arms (16);

control means including a cam (23) mounted in fixed position on the crank pins (19) of the more rearward (21) of said two crank arms (20,22) for rotating each of said carrier arms (16) about its length axis; and a control lever arm (27) for each of said carrier arms (16) connected by a control rod (26) to a pivoted lever (25) carrying a cam follower (24) cooperating with one of said cams (23), said pivoted lever being mounted by a pivot bearing on an end structure of one of said swing rod means (17);

whereby said suction sheet-pulling devices (15) are caused to be moved in a closed curve in the feed direction and back, moving below the lifted top sheet to grasp it on its underside and to lead it to a succeeding transport mechanism.

8. A sheet-feeding mechanism as defined in claim 7, in which spring means (28) are provided for pressing each of said cam followers (24) against the corresponding one of said cams (23), each of said spring means (28) being constrained at one end by a bearing structure of one of the more forward of said crank arms (20) and at the other end by a stop affixed on said control rod (26).

9. A sheet-feeding mechanism as defined in claim 8, in which in the neighborhood of the bearing (18) of the more forward of said crank arms (20) provided on each of said swing rod means (17) a loose seat or guide is provided for the adjacent control rod (26).

10. A sheet-feeding mechanism as defined in claim 7, in which said control rod (26) has pivot bearings (53) at its ends for connection respectively to said control lever arm (27) and to said pivoted lever (25).

11. A sheet-feeding mechanism provided with apparatus for repetitively separating a top sheet of a stack of sheets of material having at least the stiffness of paper and transferring said sheet to apparatus for transporting the said sheet to other apparatus capable of accepting said sheet, comprising in combination:

top sheet separator means (3) located adjacent to the front edge of a stack (1) of sheets that is in position for sheet-feeding, for lifting at least the front edge of the top sheet (2) of said stack off the top of the stack;

first and second swing rod means (17) for producing motion of their respective front ends in the respective regions of each of the front corners of said top sheet, in each case suspended on two crank arms (20,21);

an inwardly directed carrier arm (16) mounted rotatably with respect to its length axis on each of said swinging rod means (17) at the front end thereof, said carrier arms (16) being mounted axially shiftable in the respective forward ends of said swing rod means (17), motion converting means (51,52) provided for said carrier arms whereby a rotary movement of said carrier arms (16), produced under control of said cams (23) is caused to produce also an axial movement of said carrier arms (16) shifting them outwards during at least part of the forward movement of said swing rod means in order to stiffen the front edge of said top sheet;

a suction sheet-pulling device (15) on each of said carrier arms (16); and control means including a cam (23) mounted on one of said crank arms (20,22) for rotating each of said carrier arms (16) about its length axis;

whereby said suction sheet-pulling devices (15) are caused to be moved in a closed curve in the feed direction and back, moving below the lifted top sheet to grasp it on its underside and to lead it to a succeeding transport mechanism.

12. A sheet-feeding mechanism as defined in claim 11, in which said motion converting means comprises at least one oblique guiding surface (51) provided in the region of a bearing (50) in which each of said carrier arms (16) is held on a corresponding one of said swing rod means (17).

13. A sheet-feeding mechanism as defined in claim 12, in which said at least one oblique guiding surface is provided by an oblique slot (51) in each of said carrier arm bearings, which slot in each case cooperates with a pin (52) fixed to the respective carrier arm (16) for moving in the respective slot (51).

14. A sheet-feeding mechanism provided with apparatus for repetitively separating a top sheet of a stack of sheets of material having at least the stiffness of paper and transferring said sheet to apparatus for transporting the said sheet to other apparatus capable of accepting said sheet, comprising in combination:

top sheet separator means (3) located adjacent to front edge of a stack (1) of sheets that is in position for sheet-feeding, for lifting at least the front edge of the top sheet (2) of said stack off the top of the stack;

first and second swing rod means (17) for producing motion of their respective front ends in the respective regions of each of the front corners of said top sheet, in each case suspended on two crank arms (20,21) each provided with laterally disposed axle stubs (30,31) that are journaled in axially shiftable bearing plates (32);

an inwardly directed carrier arm (16) mounted rotatably with respect to its length axis on each of said swinging rod means (17) at the front end thereof, each constituted as an arm that is extendable by pulling it out;

a suction sheet-pulling device (15) on each of said carrier arms (16); and control means including a cam (23) mounted on one of said crank arms (20,21) for rotating each of said carrier arms (16) about its length axis;

whereby said suction sheet-pulling devices (15) are caused to be moved in a closed curve in the feed direction and back, moving below the lifted top sheet to grasp it on its underside and to lead it to a succeeding transport mechanism.

15. A sheet-feeding mechanism as defined in claim 14 in which said shaft stubs (31) connected to the more rearward of said crank arms (21) are engaged for transmission of rotary movement in a drive shaft (35) constituted in the form of a hollow shaft.

16. A sheet-feeding mechanism as defined in claim 15 in which said shaft stubs (31) engaged in said drive shaft constituted as a hollow shaft (35) are provided with means for rotating said stubs relative to each other during operation of said hollow drive shaft (35).

17. A sheet-feeding mechanism as defined in claim 16 in which said means for rotating said shaft stubs (31) relative to each other include oblique guides (39, 40) in said hollow drive shaft (35) and means for displacing said hollow drive shaft (35) axially.

18. A sheet-feeding mechanism as defined in claim 17 in which said oblique guides are constituted to provide a pin and groove connection (39, 40) between said shaft stubs (31) and said hollow drive shaft (35).

* * * * *